US008281700B2

(12) United States Patent
Cohen

(10) Patent No.: US 8,281,700 B2
(45) Date of Patent: Oct. 9, 2012

(54) COMPOSITE ARMOR PLATE AND CERAMIC BODIES FOR USE THEREIN

(76) Inventor: Michael Cohen, Post North Yehuda (IL)

( * ) Notice: Subject to any disclaimer, the term of this patent is extended or adjusted under 35 U.S.C. 154(b) by 297 days.

(21) Appl. No.: 12/425,703

(22) Filed: Apr. 17, 2009

(65) Prior Publication Data

US 2009/0241764 A1 Oct. 1, 2009

Related U.S. Application Data

(63) Continuation-in-part of application No. 11/187,550, filed on Jul. 22, 2005, now abandoned, which is a continuation-in-part of application No. 10/937,205, filed on Sep. 8, 2004, now abandoned.

(51) Int. Cl.
*F41H 5/04* (2006.01)

(52) U.S. Cl. ..... 89/36.02; 89/908

(58) Field of Classification Search ..... 89/36.02, 89/906, 907, 908, 909
See application file for complete search history.

(56) References Cited

U.S. PATENT DOCUMENTS

| | | | | |
|---|---|---|---|---|
| 689,232 | A * | 12/1901 | Schoch | 63/37 |
| 1,081,464 | A | 12/1913 | Pfeiffer | |
| 1,352,418 | A | 9/1920 | Boyer | |
| 2,272,272 | A | 2/1942 | Mow | |
| 3,563,836 | A | 2/1971 | Dunbar | |
| 3,705,558 | A | 12/1972 | McDougal et al. | |
| 4,061,815 | A | 12/1977 | Poole, Jr. | |
| 4,529,640 | A | 7/1985 | Brown et al. | |
| 4,534,266 | A | 8/1985 | Huet | |
| 4,836,084 | A | 6/1989 | Vogelesang et al. | |
| 4,868,040 | A | 9/1989 | Hallal et al. | |
| 4,945,814 | A | 8/1990 | Huet | |
| 5,361,678 | A | 11/1994 | Roopchand et al. | |
| 5,763,813 | A | 6/1998 | Cohen et al. | |
| 5,972,819 | A | 10/1999 | Cohen | |
| 6,112,635 | A | 9/2000 | Cohen | |
| 6,203,908 | B1 | 3/2001 | Cohen | |
| 6,289,781 | B1 | 9/2001 | Cohen | |
| 6,408,734 | B1 | 6/2002 | Cohen | |

(Continued)

FOREIGN PATENT DOCUMENTS

EP 0 843 149 A1 5/1998

(Continued)

*Primary Examiner* — Stephen M Johnson
(74) *Attorney, Agent, or Firm* — Foley & Lardner LLP

(57) ABSTRACT

The invention provides a composite armor plate for absorbing and dissipating kinetic energy from high-velocity projectiles, the plate comprising a single internal layer of pellets which are bound and retained in plate form by an elastic material, substantially internally within the elastic material, such that the pellets are bound in a plurality of spaced-apart rows and columns, the pellets being made of ceramic material, and the pellets being substantially fully embedded in the elastic material so that the pellets form an internal layer, wherein the solidified material and the plate are elastic, and wherein a majority of each of the pellets is in direct contact with six adjacent pellets in the same layer to provide mutual lateral confinement therebetween, each of the pellets being characterized by a body having a substantially regular geometric cross-sectional area and first and second end faces, each of the end faces projecting from the body and having an outwardly decreasing cross-sectional area wherein the height of the end face disposed substantially opposite to an outer impact receiving major surface of the plate is less than 15% of the length of the diameter of the pellet body from which it projects.

14 Claims, 2 Drawing Sheets

U.S. PATENT DOCUMENTS

| | | | |
|---|---|---|---|
| 6,500,507 | B1 | 12/2002 | Fisher |
| 6,745,661 | B1 | 6/2004 | Neal et al. |
| 2002/0012768 | A1 | 1/2002 | Cohen |

FOREIGN PATENT DOCUMENTS

| | | | | | |
|---|---|---|---|---|---|
| EP | 0 942 255 | A1 | | 9/1999 | |
| FR | 2711782 | A1 | | 5/1995 | |
| GB | 1 081 464 | A | | 8/1967 | |
| GB | 1 352 418 | A | | 5/1974 | |
| GB | 2 272 272 | A | | 5/1994 | |
| WO | 98/15796 | | * | 4/1998 | ..... 89/36.02 |
| WO | WO-99-60327 | | | 11/1999 | |

* cited by examiner

COMPOSITE ARMOR PLATE AND CERAMIC BODIES FOR USE THEREIN

RELATED APPLICATIONS

The present invention is a continuation-in-part of U.S. Ser. No. 11/187,550 filed on Jul. 22, 2005, now abandoned, which was a continuation-in-part of U.S. Ser. No. 10/937,205 filed on Sep. 8, 2004 now abandoned and claims priority for all purposes related thereto.

FIELD OF THE INVENTION

The present invention relates to ballistic armor panels and to a ceramic body for deployment in such armor panels, for absorbing and dissipating kinetic energy from high velocity projectiles. More particularly, the invention relates to improved ceramic bodies for use in armor plates for providing ballistic protection for light and heavy mobile equipment and for vehicles against high-velocity, armor-piercing projectiles or fragments and especially for use as add-on protection to rigid armor plates such as the steel plates of armored vehicles.

BACKGROUND

The present invention is a modification of the inventions described in U.S. Pat. Nos. 5,763,813; 5,972,819; 6,289,781; 6,112,635; 6,203,908; and 6,408,734 and in WO-A-9815796, the relevant teachings of which are incorporated herein by reference.

In U.S. Pat. No. 5,763,813 there is described and claimed a composite armor material for absorbing and dissipating kinetic energy from high velocity, armor-piercing projectiles comprising a panel consisting essentially of a single internal layer of high density ceramic pellets, said pellets having an $Al_2O_3$ content of at least 93% and a specific gravity of at least 2.5 and retained in panel form by a solidified material, which is elastic at a temperature below 250° C.; the majority of said pellets each having a part of a major axis of a length of in the range of about 3-12 mm, and being bound by said solidified material in a plurality of superposed rows, wherein a majority of each of said pellets is in contact with at least 4 adjacent pellets; the weight of said panel does not exceed 45 kg/m$^2$.

In U.S. Pat. No. 6,112,635, there is described and claimed a composite armor plate for absorbing and dissipating kinetic energy from high velocity, armor-piercing projectiles, said plate consisting essentially of a single internal layer of high density ceramic pellets which are directly bound and retained in plate form by a solidified material such that the pellets are bound in a plurality of adjacent rows, wherein the pellets have an $Al_2O_3$ content of at least 93% and a specific gravity of at least 2.5; the majority of the pellets each have at least one axis of at least 12 mm length, said one axis of substantially all of said pellets being in substantial parallel orientation with each other and substantially perpendicular to an adjacent surface of said plate and wherein a majority of each of said pellets is in direct contact with 6 adjacent pellets, and said solidified material and said plate are elastic.

In WO-A-9815796 corresponding to U.S. Pat. No. 5,972,819, there is described and claimed a ceramic body for deployment in a composite armor panel, said body being substantially cylindrical in shape, with at least one convexly curved end face, wherein the ratio D/R between the diameter D of said cylindrical body and the radius R of curvature of said at least one convexly curved end face is at least 0.64:1.

In U.S. Pat. No. 6,289,781, there is described and claimed a composite armor plate for absorbing and dissipating kinetic energy from high velocity projectiles, said plate comprising a single internal layer of pellets which are directly bound and retained in plate form by a solidified material such that the pellets are bound in a plurality of adjacent rows, characterized in that the pellets have a specific gravity of at least 2 and are made of a material selected from the group consisting of glass, sintered refractory material, ceramic material which does not contain aluminum oxide and ceramic material having an aluminum oxide content of not more than 80%, the majority of the pellets each have at least one axis of at least 3 mm length and are bound by said solidified material in said single internal layer of adjacent rows such that each of a majority of said pellets is in direct contact with at least six adjacent pellets in the same layer to provide mutual lateral confinement therebetween, said pellets each have a substantially regular geometric form and said solidified material and said plate are elastic.

In U.S. Pat. No. 6,408,734, there is described and claimed a composite armor plate for absorbing and dissipating kinetic energy from high velocity, armor-piercing projectiles, as well as from soft-nosed projectiles, said plate comprising a single internal layer of high density ceramic pellets, characterized in that said pellets are arranged in a single layer of adjacent rows and columns, wherein a majority of each of said pellets is in direct contact with at least four adjacent pellets and each of said pellets are substantially cylindrical in shape with at least one convexly-curved end face, further characterized in that spaces formed between said adjacent cylindrical pellets are filled with a material for preventing the flow of soft metal from impacting projectiles through said spaces, said material being in the form of a triangular insert having concave sides complimentary to the convex curvature of the sides of three adjacent cylindrical pellets, or being integrally formed as part of a special interstices-filling pellet, said pellet being in the form of a six sided star with concave sides complimentary to the convex curvature of the sides of six adjacent cylindrical pellets, said pellets and material being bound and retained in plate form by a solidified material, wherein said solidified material and said plate material are elastic.

The teachings of all of these specifications are incorporated herein by reference.

As described and explained therein, an incoming projectile may contact the pellet array in one of three ways.

1. Center contact. The impact allows the full volume of the pellet to participate in stopping the projectile, which cannot penetrate without pulverizing the whole pellet, an energy-intensive task.
2. Flank contact. The impact causes projectile yaw, thus making projectile arrest easier, as a larger frontal area is contacted, and not only the sharp nose of the projectile. The projectile is deflected sideways and needs to form for itself a large aperture to penetrate, thus allowing the armor to absorb the projectile energy.
3. Valley contact. The projectile is jammed, usually between the flanks of three pellets, all of which participate in projectile arrest. The high side forces applied to the pellets are resisted by the pellets adjacent thereto as held by the substrate or plate, and penetration is prevented.

There are four main considerations concerning protective armor panels. The first consideration is weight. Protective armor for heavy but mobile military equipment, such as tanks and large ships, is known. Such armor usually comprises a thick layer of alloy steel, which is intended to provide protection against heavy and explosive projectiles. However, reduction of weight of armor, even in heavy equipment, is an advantage since it reduces the strain on all the components of the vehicle. Furthermore, such armor is quite unsuitable for light vehicles such as automobiles, jeeps, light boats, or aircraft, whose performance is compromised by steel panels having a thickness of more than a few millimeters, since each millimeter of steel adds a weight factor of 7.8 kg/m$^2$.

Armor for light vehicles is expected to prevent penetration of bullets of any type, even when impacting at a speed in the range of 700 to 1000 meters per second. However, due to weight constraints, it is difficult to protect light vehicles from high-caliber, armor-piercing projectiles, e.g. of 12.7 and 14.5 mm and above, since the weight of standard armor to withstand such projectile is such as to impede the mobility and performance of such vehicles.

A second consideration is cost. Overly complex armor arrangements, particularly those depending entirely on composite materials, can be responsible for a notable proportion of the total vehicle cost, and can make its manufacture non-profitable.

A third consideration in armor design is compactness. A thick armor panel, including air spaces between its various layers, increases the target profile of the vehicle. In the case of civilian retrofitted armored automobiles which are outfitted with internal armor, there is simply no room for a thick panel in most of the areas requiring protection.

A fourth consideration relates to ceramic plates used for personal and, light vehicle armor, which plates have been found to be vulnerable to damage from mechanical impacts caused by rocks, falls, etc.

Fairly recent examples of armor systems are described in U.S. Pat. No. 4,836,084, disclosing an armor plate composite including a supporting plate consisting of an open honeycomb structure of aluminum; and U.S. Pat. No. 4,868,040, disclosing an antiballistic composite armor including a shock-absorbing layer. Also of interest is U.S. Pat. No. 4,529,640, disclosing spaced armor including a hexagonal honeycomb core member.

Other armor plate panels are disclosed in British Patents 1,081,464; 1,352,418; 2,272,272, and in U.S. Pat. No. 4,061,815 wherein the use of sintered refractory material, as well as the use of ceramic materials, are described.

In the majority of the patents by the present inventor, the preferred embodiments are pellets having a cylindrical body and at least one convexly curved end face and the especially preferred embodiment is that described in U.S. Pat. No. 5,972,819 wherein the body is substantially cylindrical in shape with at least one convexly curved end face, and preferably two identical convexly curved end faces, wherein the ratio D/R between the diameter D of said cylindrical body and the radius R of curvature of said convexly curved end faces is at least 0.64:1.

It has now been found that when mounting composite armor panels as add-on protection for the rigid steel armor of light and heavy armored vehicles, the pellet itself is capable of damaging or even penetrating said rigid steel armor backing.

SUMMARY OF THE INVENTION

With this state of the art and these considerations in mind, there is now provided according to the present invention a composite armor plate for absorbing and dissipating kinetic energy from high-velocity projectiles, said plate comprising a single internal layer of pellets which are bound and retained in plate form by an elastic material, substantially internally within said elastic material, such that the pellets are bound in a plurality of spaced-apart rows and columns, said pellets being made of ceramic material; and said pellets being substantially fully embedded in the elastic material so that the pellets form an internal layer, wherein said solidified material and said plate are elastic, and wherein a majority of each of said pellets is in direct contact with six adjacent pellets in the same layer to provide mutual lateral confinement therebetween, each of said pellets including a body having a substantially regular geometric cross-sectional area and first and second end faces, each of said end faces projecting from said body and having an outwardly decreasing cross-sectional area wherein the height of the end face disposed substantially opposite to an outer impact receiving major surface of said plate is less than 15% of the length of the diameter of the pellet body from which it projects.

Preferably, the height of the end face disposed substantially opposite to an outer impact receiving major surface of said plate is less than the height of the impact receiving end face.

In first preferred embodiments of the present invention, the end face disposed substantially opposite to an outer impact receiving major surface of said plate is spherical.

In these first preferred embodiments, especially preferred are pellets wherein said end-face is convexly curved and wherein the ratio D/R between the diameter D of the body of the pellet and the radius R of the curvature of said convexly curved end face is between about 0.28:1 and 0.639:1.

In further preferred embodiments of the present invention, the end face disposed substantially opposite to an outer impact receiving major surface of said plate is in the form of an outwardly tapered truncated cone forming a chamfered end.

As stated, the composite armor plate and pellets of the present invention are especially preferred whenever used as ballistic protection for a rigid armor plate since it has been found that they increase the area distribution of the initial impact of the pellet as transferred by inertia from the impacting projectile.

Thus the major difference between the plate and pellets of the present invention and those of the prior plates and pellets in this series is in the shape and size of the end face disposed substantially opposite to the outer impact receiving major surface of the plate however, nevertheless it is still preferred that a majority of said pellets have at least one convexly-curved end face oriented to substantially face in the direction of an outer impact receiving major surface of said plate.

As stated, the present invention also provides a pellet for use in a composite armor plate for absorbing and dissipating kinetic energy from high-velocity projectiles, said pellet being made of a ceramic material and said pellet having a substantially regular geometric cross-sectional area, and first and second end faces, each of said end faces projecting from said body and having an outwardly decreasing cross-sectional area wherein the height of the end face disposed substantially opposite to an outer impact receiving end face of said pellet is less than 15% of the length of the diameter of the pellet body from which it projects.

In preferred embodiments of this aspect of the present invention there is provided a pellet for use in a composite armor plate for absorbing and dissipating kinetic energy from high-velocity projectiles, wherein the height of the end face disposed substantially opposite to an outer impact receiving end face of said pellet is less than the height of the impact receiving end face.

In the preferred embodiments of the present invention said pellets have at least one axis of at least 9 mm and the present invention is especially applicable and preferred for use with plates incorporating pellets having at least one axis of at least 20 mm.

In yet further embodiments of the present invention a channel is provided in a plurality of said pellets to reduce the weight per area thereof.

In said further embodiments said channel preferably occupies a volume of up to 25% of said pellet.

The term "regular geometric" as used herein refers to forms that are regular forms such as circles and ovals as well as forms that repeat themselves including star shapes, polygonal cross-sectional shapes and multiple repeating patterns of alternating straight and curved segments characterized in that a cut along said regular geometric cross-sectional area or perpendicular thereto results in two surfaces which are symmetrical.

The term "elasticity" as used herein relates to the fact that the plates according to the present invention are bent when a load is applied thereto however upon release of said load the plate returns to its original shape without damage.

The armor plates described in EP-A-0843149 and European Patent Application 98301769.0 are made using ceramic pellets made substantially entirely of aluminum oxide. In WO-A-9815796 the ceramic bodies are of substantially cylindrical shape having at least one convexly-curved end-face, and are preferably made of aluminum oxide.

In WO 99/60327 it was described that the improved properties of the plates described in the earlier patent applications of this series is as much a function of the configuration of the pellets, which are of regular geometric form with at least one convexly-curved end face (for example, the pellets may be spherical or ovoidal, or of regular geometric cross-section, such as hexagonal, with at least one convexly-curved end face), said panels and their arrangement as a single internal layer of pellets bound by an elastic solidified material, wherein each of a majority of said pellets is in direct contact with at least four adjacent pellets and said curved end face of each pellet is oriented to substantially face in the direction of an outer impact-receiving major surface of the plate. As a result, said specification teaches that composite armor plates superior to those available in the prior art can be manufactured using pellets made of sintered refractory materials or ceramic materials having a specific gravity below that of aluminum oxide, e.g., boron carbide with a specific gravity of 2.45, silicon carbide with a specific gravity of 3.2 and silicon aluminum oxynitride with a specific gravity of about 3.2.

Thus, it was described in said publication that sintered oxides, nitrides, carbides and borides of magnesium, zirconium, tungsten, molybdenum, titanium and silica can be used and especially preferred for use in said publication and also in the present invention the ceramic bodies utilized herein are formed of a ceramic material selected from the group consisting of sintered oxide, nitrides, carbides and borides of alumina, magnesium, zirconium, tungsten, molybdenum, titanium and silica.

All of these features are incorporated herein as preferred embodiments of the present invention.

More particularly, the present invention to a ceramic body as defined for absorbing and dissipating kinetic energy from high velocity armor piercing projectiles, wherein said body is made of a material selected from the group consisting of alumina, boron carbide, boron nitride, titanium diboride, silicon carbide, silicon oxide, silicon nitride, magnesium oxide, silicon aluminum oxynitride and mixtures thereof.

In preferred embodiments of the present invention, said pellets each have a major axis and said pellets are arranged with their major axes substantially parallel to each other and oriented substantially perpendicularly relative to said outer impact-receiving major surface of said panel.

Thus, in preferred embodiments of the present invention there is provided a composite armor plate as herein defined, wherein a majority of said pellets have at least one convexly-curved end face oriented to substantially face in the direction of an outer impact receiving major surface of said plate.

The solidified material can be any suitable material, such as aluminum, a thermoplastic polymer such as polycarbonate, or a thermoset plastic such as epoxy or polyurethane.

When aluminum is used as said solidified material an x-ray of the plate shows the formation of a honeycomb structure around the pellets.

In French Patent 2,711,782, there is described a steel panel reinforced with ceramic materials; however said panel does not have the ability to deflect armor-piercing projectiles unless a thickness of about 8-9 mm of steel is used, which adds undesirable excessive weight to the panel and further backing is also necessary, thereby further increasing the weight thereof.

The composite armor plate according to the present invention can be used in conjunction with and as an addition to the standard steel plates provided on armored vehicles or as add on armor for armored vehicles having aluminum or titanium containing rigid surfaces, as well as in conjunction with the laminated armor described and claimed in U.S. Pat. No. 6,497,966 the teachings of which are incorporated herein by reference.

According to a further aspect of the invention, there is provided a multilayered armor panel, comprising an outer, impact-receiving layer formed by a composite armor plate as hereinbefore defined for deforming and shattering an impacting high velocity projectile; and an inner layer adjacent to said outer layer and, comprising a ballistic material for absorbing the remaining kinetic energy from said fragments. Said ballistic material will be chosen according to cost and weight considerations and can be made of any suitable material such as Dyneema, Kevlar, aluminum, steel, titanium, or S2.

As described, e.g., in U.S. Pat. No. 5,361,678, composite armor plate comprising a mass of spherical ceramic balls distributed in an aluminum alloy matrix is known in the prior art. However, such prior art composite armor plate suffers from one or more serious disadvantages, making it difficult to manufacture and less than entirely suitable for the purpose of defeating metal projectiles. More particularly, in the armor plate described in said patent, the ceramic balls are coated with a binder material containing ceramic particles, the coating having a thickness of between 0.76 and 1.5 mm and being provided to help protect the ceramic cores from damage due to thermal shock when pouring the molten matrix material during manufacture of the plate. However, the coating serves to separate the harder ceramic cores of the balls from each other, and will act to dampen the moment of energy which is transferred and hence shared between the balls in response to an impact from a bullet or other projectile. Because of this and also because the material of the coating is inherently less hard than that of the ceramic cores, the stopping power of a plate constructed as described in said patent is not as good, weight for weight, as that of a plate in accordance with the present invention.

U.S. Pat. No. 3,705,558 discloses a lightweight-armor plate comprising a layer of ceramic balls. The ceramic balls are in contact with each other and leave small gaps for entry of molten metal. In one embodiment, the ceramic balls are encased in a stainless steel wire screen; and in another embodiment, the composite armor is manufactured by adhering nickel-coated alumina spheres to an aluminum alloy plate by means of a polysulfide adhesive. A composite armor plate as described in this patent is difficult to manufacture because the ceramic spheres may be damaged by thermal shock arising from molten metal contact. The ceramic spheres are also sometimes displaced during casting of molten metal into interstices between the spheres.

In order to minimize such displacement, U.S. Pat. Nos. 4,534,266 and 4,945,814 propose a network of interlinked metal shells to encase ceramic inserts during casting of molten metal. After the metal solidifies, the metal shells are incorporated into the composite armor. It has been determined, however, that such a network of interlinked metal shells substantially increases the overall weight of the armored panel and decreases the stopping power thereof.

It is further to be noted that U.S. Pat. No. 3,705,558 suggests and teaches an array of ceramic balls disposed in contacting pyramidal relationship, which arrangement also substantially increases the overall weight of the armored panel and decreases the stopping power thereof, due to a billiard-like effect upon impact.

As will be realized, when preparing the composite armor plate of the present invention, said pellets do not necessarily have to be completely covered on both sides by said solidified material, and the term internal layer as used herein is intended to denote that the pellets are either completely or almost completely covered by said solidified material, wherein outer face surfaces of the plate are formed from the solidified material, the plate having an outer impact receiving face, at which face each pellet is either covered by the solidified material, touches said solidified material which forms surfaces of said outer impact receiving face or, not being completely covered by said solidified material which constitutes surfaces of said outer impact receiving face, bulges therefrom, the solidified material and hence the plate being elastic.

In U.S. Ser. No. 09/924,745 there is described and claimed a composite armor plate for absorbing and dissipating kinetic energy from high velocity projectiles, said plate comprising a single internal layer of pellets which are directly bound and retained in plate form by a solidified material such that the pellets are bound in a plurality of adjacent rows, said pellets having a specific gravity of at least 2 and being made of a material selected from the group consisting of glass, sintered refractory material and ceramic material, the majority of the pellets each having at least one axis of at least 3 mm length and being bound by said solidified material in said single internal layer of adjacent rows such that each of a majority of said pellets is in direct contact with six adjacent pellets in the same layer to provide mutual lateral confinement therebetween, said pellets each having a substantially regular geometric form, wherein said solidified material and said plate are elastic, characterized in that a channel is provided in each of a plurality of said pellets, substantially opposite to an outer impact-receiving major surface of said plate, thereby reducing the weight per area of each of said pellets.

In preferred embodiments described therein each of said channels occupies a volume of up to 25% within its respective pellet.

Said channels can be bored into preformed pellets or the pellets themselves can be pressed with said channel already incorporated therein.

The teachings of said specification are also incorporated herein by reference.

Thus, in preferred embodiments of the present invention a channel is provided in the pellets of the armor of the present invention to further reduce the weight per area thereof and preferably said channel occupies a volume of up to 25% of said body.

In accordance with the present invention said channels are preferably of a shape selected from the group consisting of cylindrical, pyramidal, hemispherical and quadratic, hexagonal prism and combinations thereof.

As is known, there exists a ballistic effect known in the art in which a projectile striking a cylinder at an angle has a tendency to move this cylinder out of alignment causing a theoretical possibility that a second shot would have more penetration effect on a panel.

As will be realized, since material is removed from the pellets of the present invention their weight is decreased, as is the overall weight of the entire composite armor plate from which they are formed, thereby providing the unexpected improvement of reduced weight of protective armor panels without loss of stopping power.

BRIEF DESCRIPTION OF THE DRAWINGS

The invention will now be described in connection with certain preferred embodiments with reference to the following illustrative figures so that it may be more fully understood.

With reference now to the figures in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

In the drawings:

FIG. 1 is an elevational view of a first preferred pellet according to the present invention;

FIG. 2 is an elevational view of a second preferred pellet according to the present invention;

FIG. 3 is an elevational view of a third preferred pellet according to the present invention;

FIG. 4 is an elevational view of a fourth preferred pellet according to the present invention;

FIG. 5 is a cutaway perspective view of an armor panel having spaced apart inner and outer plates and a plurality of pellets dispersed therebetween; and FIG. 6 is a perspective view of a group of pellets according to the present invention seen prior to insertion between plates to form the armor panel.

DETAILED DESCRIPTION

Figure 1:
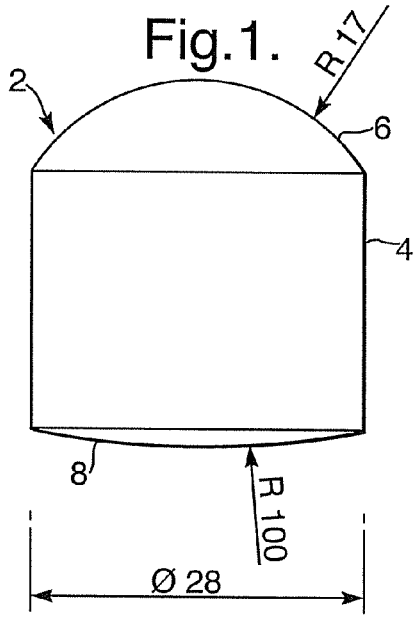

Referring to FIG. 1 there is seen an elevational view of a preferred pellet 2 according to the present invention having a substantially cylindrical body 4 and two convexly curved end faces 6 and 8. As indicated in the drawing, end face 6 which is designed to serve as the outer impact receiving end face of the pellet 2 has a radius of curvature of 17 mm as indicated by the letter R and the cylinder has a diameter of 28 mm. In contradistinction the end face 8 designed to be disposed substantially opposite to the outer impact receiving end face 6 has a spherical surface with a radius of curvature of 100 mm. Thus as will be realized, in this embodiment, the ratio D/R between the diameter of the body of the pellet and the radius R of the curvature of said convexly curved end face 8 is 0.28:1.

Figure 2:
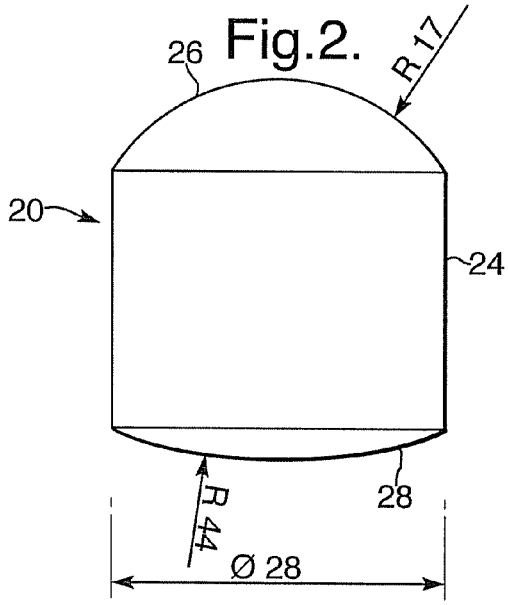

Referring to FIG. 2 there is seen an elevational view of a further preferred pellet 20 according to the present invention having a substantially cylindrical body 24 and two convexly curved end faces 26 and 28. As indicated in the drawing, end face 26 which is designed to serve as the outer impact receiving end face of the pellet 20 has a radius of curvature of 17 mm as indicated by the letter R and the cylinder has a diameter of 28 mm. In contradistinction the end face 28 designed to be disposed substantially opposite to the outer impact receiving end face 26 has a spherical surface with a radius of curvature of 44 mm. Thus as will be realized, in this embodiment, the ratio D/R between the diameter of the body of the pellet and the radius R of the curvature of said convexly curved end face 28 is 0.636:1.

Pellets having a ratio D/R between the diameter of the body and of the pellet and the radius R of the curvature of the convexly curved end face which is disposed opposite the impact receiving end face between about 0.28:1 and about 0.636:1 have been found to function equally well in the armor panel of the present invention.

Figure 3:
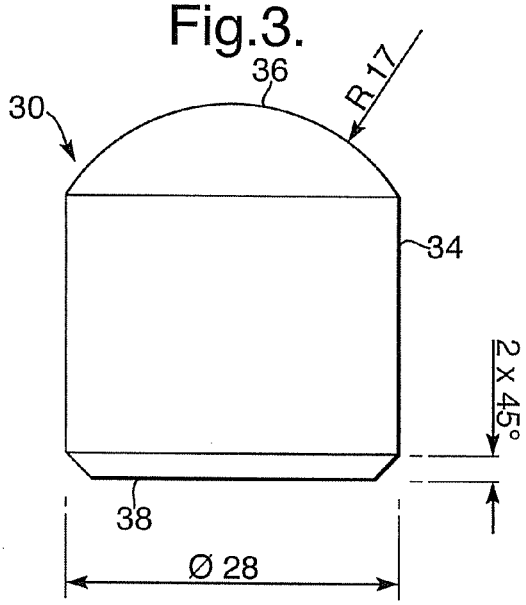

Referring to FIG. 3 there is seen an elevational view of yet a further preferred pellet 30 according to the present invention having a substantially cylindrical body 34 with one convexly curved end face 36 and a further end face 38 disposed substantially opposite to the outer impact receiving end face 36 wherein said end face 38 is in the form of an outwardly tapered truncated cone. As with the embodiments discussed with reference to FIGS. 1 and 2, end face 36 which is designed to serve as the outer impact receiving end face of the pellet 30 has a radius of curvature of 17 mm as indicated by the letter R and the cylinder has a diameter of 28 mm. In contradistinction, the end face 38 designed to be disposed substantially opposite to the outer impact receiving end face 36 is in the form of a chamfer with a height (h) of 2 mm and wherein the angle of the outwardly tapered truncated cone vis a vis the cylindrical body is 45°. Thus as will be realized, in this embodiment, the height (h) of the end face 38 is less than 15% of the length of the diameter of the pellet body from which it projects and in fact is less than 10% of the length of the diameter of the pellet body.

Figure 4:
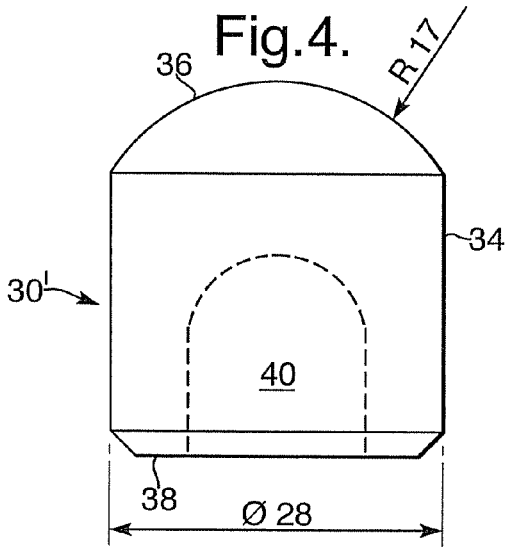

Referring now to FIG. 4 there is seen a variation of the pellet 30 as described with reference to FIG. 3 and similar numbers have been used to describe similar parts. Thus as seen, said pellet, 30' is formed of a cylindrical body 34 with one convexly curved end face 36 and a further end face 38 disposed substantially opposite to the outer impact receiving end face 36 wherein said end face 38 is in the form of an outwardly tapered truncated cone. As with the embodiments discussed with reference to FIGS. 1 and 2, end face 36 which is designed to serve as the outer impact receiving end face of the pellet 30' has a radius of curvature of 17 mm as indicated by the letter R and the cylinder has a diameter of 28 mm. In contradistinction the end face 38 designed to be disposed substantially opposite to the outer impact receiving end face 36 is in the form of a chamfer with a height of 2 mm and wherein the angle of the outwardly tapered truncated cone vis a vis the cylindrical body is 45°. In addition said pellet 30' is provided with a channel 40 substantially opposite to the outer impact-receiving end face 36 of said pellet, thereby reducing the weight per area of said pellet. In the embodiment shown, said channel has a diameter of 15 mm.

The pellets 2, 20, 30 and 30' are all formed of a ceramic material. Preferred ceramics are sintered oxide, nitrides, carbides and borides of alumina, magnesium, zirconium, tungsten, molybdenum, titanium and silica.

Preferred materials are typically alumina, boron carbide, boron nitride, titanium diboride, silicon carbide, silicon oxide, silicon nitride, magnesium oxide, silicon aluminum oxynitride and mixtures thereof.

Figure 5:
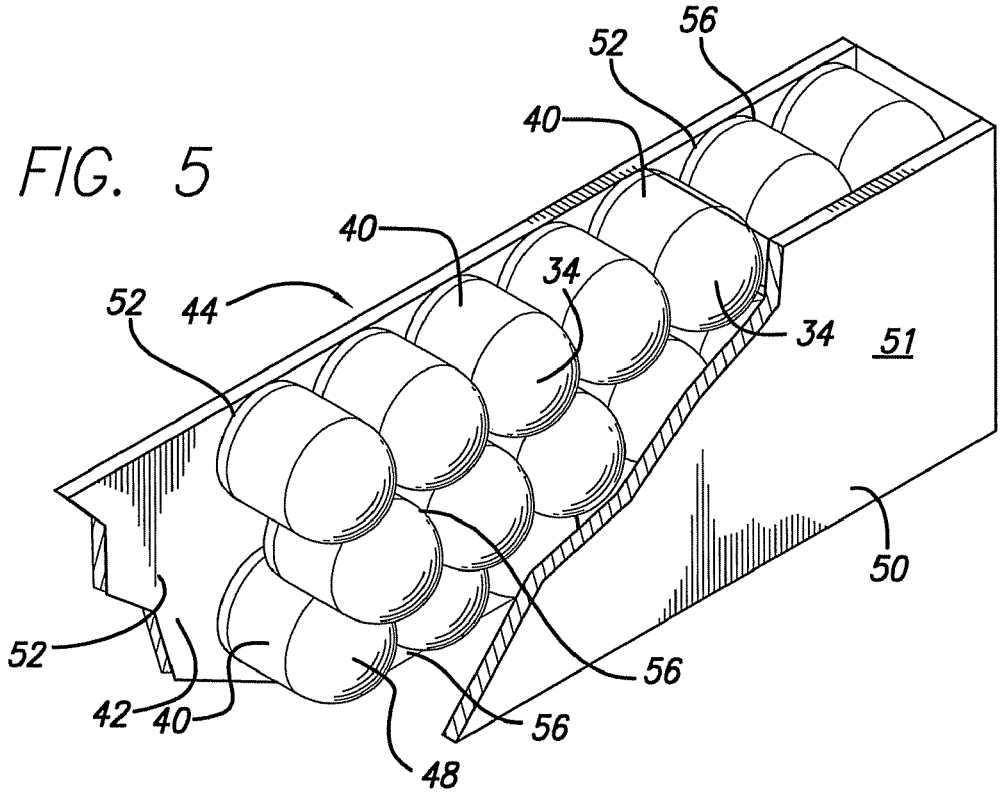

Referring now to FIG. 5 there is seen an armor panel 44 having spaced apart inner 42 and outer 50 plates. A plurality of pellets 40 constructed as above described are constrained between the plates 42 and 50. The ceramic pellets 40 are of the type described in FIGS. 1, 2, 3 and 4, each having outwardly facing impact receiving convexly curved end faces 48 and inwardly facing end faces 52. When the ceramic pellets are as described in FIGS. 3 and 4, the height of the end face 52 disposed substantially opposite to the outer impact receiving major surface 51 of said plate 50 is less than 15% of the length of the diameter of the pellet body 40 from which it projects. When the ceramic pellets are as shown in FIGS. 1 and 2, the end face 52 opposite the impact receiving end face 48 is also convexly curved but has a radius of curvature such that the ratio D/R between the diameter of the body and the radius of curvature of the end face 52 is between about 0.28:1 and about 0.636:1. Whether the ceramic pellets are as shown in FIGS. 1 and 2 or FIGS. 3 and 4, the height of the end face 52 of the pellet 40 disposed substantially opposite to the outer impact receiving major surface 51 of the plate 50 of said panel 44 is less than the height of the impact receiving end face 48 of said pellet 40. As will be noted the entire array of pellets 40 is bound in said single layer of a plurality of adjacent rows by solidified epoxy 56.

Figure 6:
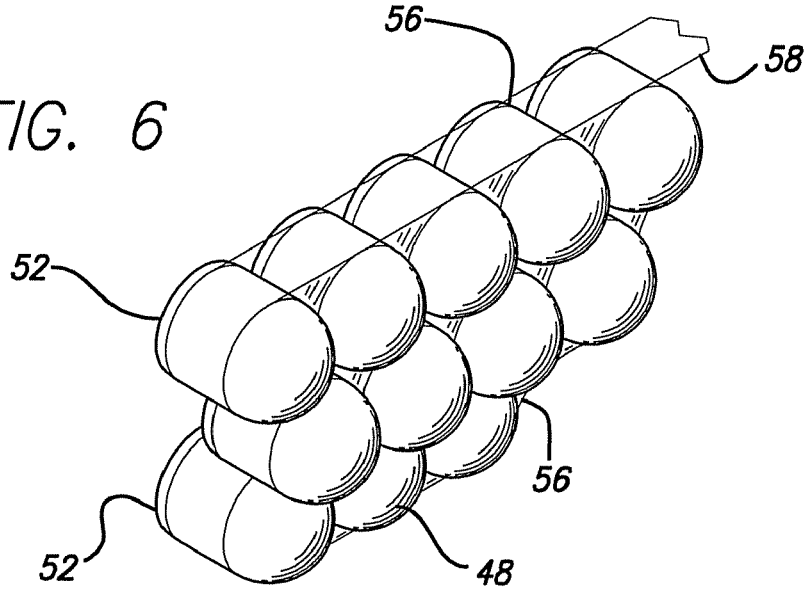

Referring now to FIG. 6, this figure illustrates a further composite armor for absorbing and dissipating kinetic energy from high velocity bullets. A panel is provided with a single internal layer of a plurality of high density ceramic pellets 40 wherein the bodies are bound and retained in a paneled form by solidified material 56, such material is suitably an epoxy resin for applications where weight is the overriding consideration. The pellets 40, which have been previously described with reference to FIG. 5, are arranged in a plurality of adjacent rows and columns. The top row of pellets 40 is seen in proximity to the upper edge 58 of an armor panel (not shown) as seen in FIG. 5. The pellets are provided with outwardly facing impact receiving convexly curved end faces 48 and inwardly facing convexly curved end faces 52. This figure refers to the stage before addition of the front and rear plates 42 and 50 seen in FIG. 5. As will be noted, the height of the end face 52 of the pellet 40 is less than the height of the impact receiving end face 48 of said pellet 40.

As illustrated in FIGS. 5 and 6, the plurality of ceramic pellets is arranged in a single layer of adjacent rows and columns. The major axis of the pellets is arranged in substantially parallel orientation with each other and substantially perpendicular to an adjacent surface of the plates 42 and 50. As shown in FIGS. 5 and 6, each of the ceramic pellets is in direct contact with six adjacent pellets to provide mutual lateral confinement therebetween.

It will be evident to those skilled in the art that the invention is not limited to the details of the foregoing illustrative embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A composite armor plate for absorbing and dissipating kinetic energy from high-velocity projectiles, said plate comprising:

a single internal layer of pellets which are bound and retained in plate form by a solidified elastic material, substantially internally within said solidified elastic material, such that the pellets are bound in a plurality of spaced-apart rows and columns, said pellets being made of ceramic material, and said pellets being substantially fully embedded in the solidified elastic material so that the pellets form an internal layer, wherein said solidified elastic material and said plate are elastic, wherein a majority of each of said pellets is in direct contact with six adjacent pellets in a same layer to provide mutual lateral confinement between the pellets, each of said pellets including:

a body having a substantially regular geometric cross-sectional area; and first and second end faces, each of said first and second end faces projecting from said body and having an outwardly decreasing cross-sectional area, wherein a height of projection from the body of one of the first and second end faces disposed substantially opposite to an outer impact receiving major surface of said plate is less than 15% of a length of a diameter of the body from which it projects, and wherein the height of projection from the body of the one of the first and second end faces disposed substantially opposite to the outer impact receiving major surface is less than a height of projection from the body of the other of the first and second end faces that comprises an impact receiving end face of said pellet.

2. A composite armor plate according to claim 1, wherein the one of the first and second end faces disposed substantially opposite to the outer impact receiving major surface is spherical.

3. A composite armor plate according to claim 2, wherein the one of the first and second end faces disposed opposite said impact receiving major surface is convexly curved and wherein a ratio D/R between the diameter of the body and a radius of curvature of the one of the first and second end faces disposed opposite said outer impact receiving major surface is between about 0.28:1 and 0.639:1.

4. A composite armor plate according to claim 1, wherein the one of the first and second end faces disposed substantially opposite to the outer impact receiving major surface is in a form of an outwardly tapered truncated cone.

5. A composite armor plate according to claim 1, wherein a majority of said pellets have at least one convexly-curved end face oriented to substantially face in a direction of the outer impact receiving major surface.

6. A composite armor plate according to claim 1, wherein said pellets have at least one axis of at least 9 mm.

7. A composite armor plate according to claim 1, wherein said pellets have at least one axis of at least 20 mm.

8. A composite armor plate according to claim 1, wherein each of said pellets is formed of a ceramic material selected from the group consisting of sintered oxide, nitrides, carbides and borides of alumina, magnesium, zirconium, tungsten, molybdenum, titanium and silica.

9. A composite armor plate according to claim 1, wherein each of said pellets is formed of a material selected from the group consisting of alumina, boron carbide, boron nitride, titanium diboride, silicon carbide, silicon oxide, silicon nitride, magnesium oxide, silicon aluminum oxynitride and mixtures thereof.

10. A composite armor plate according to claim 1, wherein said solidified elastic material and said plate comprise elastic.

11. A composite armor plate according to claim 1, wherein a plurality of said pellets have a channel extending inwardly from said one of the first and second end faces disposed opposite said outer impact receiving major surface to reduce the weight per area thereof.

12. A composite armor plate according to claim 11, wherein said channel occupies a volume of up to 25% of said pellet.

13. A pellet for use in a composite armor plate for absorbing and dissipating kinetic energy from high-velocity projectiles, said pellet comprising:

a body; and first and second end faces, each of said end faces projecting from said body and having an outwardly decreasing cross-sectional area, wherein a height of projection from the body of one of the first and second end faces disposed substantially opposite to an outer impact receiving end face of said pellet is less than 15% of a length of a diameter of the body from which it projects, wherein the height of projection from the body of the one of the first and second end faces disposed substantially opposite to the outer impact receiving end face is less than a height of projection from the body of the outer impact receiving end face, and wherein the pellet is made of a ceramic material and has a substantially regular geometric cross-sectional area.

14. A composite armor plate for absorbing and dissipating kinetic energy from high-velocity projectiles, said plate comprising:

a single internal layer of pellets which are bound and retained in plate form by a solidified elastic material, substantially internally within said solidified elastic material, such that the pellets are bound in a plurality of spaced-apart rows and columns, said pellets being made of ceramic material, and said pellets being substantially fully embedded in the solidified elastic material so that the pellets form an internal layer, wherein said solidified elastic material and said plate are elastic, wherein a majority of each of said pellets is in direct contact with six adjacent pellets in the same layer to provide mutual lateral confinement between the pellets, each of said pellets including:

a body having a substantially regular geometric cross-sectional area, the body being cylindrical, and first and second end faces, each of said first and second end faces projecting from said body and having an outwardly decreasing cross-sectional area wherein one of the first and second end faces disposed substantially opposite to an outer impact receiving major surface of said plate is spherical, wherein a height of projection from the body of the one of the first and second end faces disposed substantially opposite to said outer impact receiving major surface is less than 15% of a length of a diameter of the body from which it projects, wherein a ratio between the diameter of the body and a radius of curvature of said one of the first and second end faces is about 0.28:1 and 0.639:1, and wherein the height of projection from the body of the one of the first and second end faces disposed substantially opposite to the outer impact receiving major surface is less than a height of projection from the body of the other of the first and second end faces that comprises an impact receiving end face of said pellet.

* * * * *